US005255008A

United States Patent [19]

Yoshida

[11] Patent Number: 5,255,008

[45] Date of Patent: Oct. 19, 1993

[54] ELECTROPHOTOGRAPHIC PRINTER USING A CONTINUOUS FORM RECORDING SHEET

[75] Inventor: Tatsuya Yoshida, Saitama, Japan

[73] Assignee: Asahi Kogaku Kogyo Kabushiki Kaisha, Tokyo, Japan

[21] Appl. No.: 783,122

[22] Filed: Oct. 28, 1991

Related U.S. Application Data

[63] Continuation of Ser. No. 560,749, Jul. 31, 1990, abandoned.

[30] Foreign Application Priority Data

Jul. 31, 1989 [JP] Japan ..... 1-89943

[51] Int. Cl.[5] ..... G03G 15/00

[52] U.S. Cl. ..... 346/24; 346/136; 355/310; 225/101; 225/105

[58] Field of Search ..... 346/24, 136, 160; 355/110; 358/304; 225/101, 105, 100, 4

[56] References Cited

U.S. PATENT DOCUMENTS

| | | | |
|---|---|---|---|
| 3,794,228 | 2/1974 | Colwill | 225/101 X |
| 3,863,821 | 2/1975 | Van Bennekom | 225/101 X |
| 3,914,047 | 10/1975 | Hunt, Jr. et al. | 355/16 |
| 3,987,949 | 10/1976 | Manning et al. | 225/106 |
| 4,616,925 | 10/1986 | Sano | 355/310 X |
| 4,688,708 | 8/1987 | Irvine et al. | 225/100 |
| 4,707,704 | 11/1987 | Allen et al. | 346/24 |
| 4,819,024 | 4/1989 | Kagayama | 355/310 X |
| 4,862,378 | 8/1989 | Melton | 225/4 X |
| 4,870,434 | 9/1989 | Negishi et al. | 346/160 |
| 4,890,140 | 12/1989 | Negoro et al. | 355/290 |
| 4,912,490 | 3/1990 | Negoro et al. | 346/160 |
| 4,941,377 | 7/1990 | Ishihara et al. | 83/211 |
| 4,946,086 | 8/1990 | Suuronen | 225/105 X |
| 4,963,896 | 10/1990 | Murasaki | 346/24 X |
| 4,963,941 | 10/1990 | Negishi et al. | 355/282 |
| 5,012,295 | 4/1991 | Ikkatai et al. | 355/311 |
| 5,063,416 | 11/1991 | Honda et al. | 355/316 |

FOREIGN PATENT DOCUMENTS

| | | |
|---|---|---|
| 0288089 | 10/1988 | European Pat. Off. . |
| 2646342 | 4/1977 | Fed. Rep. of Germany . |
| 3500520 | 7/1985 | Fed. Rep. of Germany . |
| 3801201 | 7/1988 | Fed. Rep. of Germany . |
| 3811414 | 10/1988 | Fed. Rep. of Germany . |
| 3823607 | 1/1989 | Fed. Rep. of Germany . |

*Primary Examiner*—Joseph W. Hartary
*Attorney, Agent, or Firm*—Sandler Greenblum & Bernstein

[57] ABSTRACT

In a printing device such as a laser beam printer utilizing a continuous-form recording sheet, provided are feeding member for feeding the continuous-from recording sheet along a predetermined feeding path; forming member for forming the image on the continuous-form recording sheet having been fed by by the feeding member; detecting member for detecting a boundary on the continuous-form recording sheet fed by the feeding member between segments on which the image forming operation by the forming member has been executed and segments on which the image forming member is not executed; cutting member for cutting the continuous-form recording sheet is divided into two portions along the predetermined feeding path. Thus, the portion on which the image has been formed is discharged form the printer, and it becomes possible to avoid the waste of the continuous-form recording sheet, and to set a length between he forming member and the fixing member irrespective of the interval of length of the perforations provided on the continuous-form recording sheet.

10 Claims, 7 Drawing Sheets

ELECTROPHOTOGRAPHIC PRINTER USING A CONTINUOUS FORM RECORDING SHEET

This application is a continuation of application Ser. No. 07/560,749, filed Jul. 31, 1990, abandoned.

BACKGROUND OF THE INVENTION

1. Field of the Invention

The present invention relates to a printer for forming an image on a continuous-form recording sheet using an electrophotographic method.

2. Background and Material Information

There have been conventionally known image forming apparatuses using the so-called electrophotographic method, such as with an electronic copying machine, in which an electrostatic latent image is formed by exposing a photoreceptor on the surface of a charged photoconductive drum. Toner is adhered to the latent image for development, then transferred to a recording sheet arranged to be synchronously fed with the photoconductive drum and thereafter fixed by a fixing unit.

Another example is a laser beam printer arranged so as to obtain a hard copy of image information by scanning and exposing a charged photoconductive drum by modulated laser beams, based on the image to be developed (including figures, characters and the like), using the copy process of the above electrophotographic method.

The laser beam printer is very useful and versatile, because it can be used to draw figures of information received by an image reading unit, such as an image scanner, or used to output information at a high speed.

In general, such a laser beam-printer is based upon a conventional well-known electronic copying machine, and employs pre-cut individual sheets, which are cut into predetermined sizes, as a recording medium on which the desired image is formed. A so-called heat roller-type fixing unit, which has a pair of fixing rollers including a heat roller arranged to be heated with high temperatures, and a backup roller arranged to be brought into contact with the heat roller at a predetermined pressure force, is utilized. The recording medium, on which an unfixed toner image corresponding to the image information is formed, is caused to pass between the rollers so that it is heated and pressed, whereby the toner is melted and adhered on the recording medium, causing the desired image to be formed and fixed on the surface of the recording medium.

The electrophotographic method is used, that is, the rotation of a photoconductive drum causes an exposed portion thereof to reach a transfer unit, thereafter a toner image is transferred onto the recording sheet which is fed at a predetermined speed which is identical with the peripheral speed of the photoconductive drum at the transfer unit. Thus, in this process, it is impossible to form images intermittently by interrupting the process.

Therefore, the laser beam printer is provided with a memory capable of storing image information data for at least one page, and when the image information data for one page is completely input therein, the printer outputs the data one page at a time.

This laser beam printer can be used as an output terminal of a computer. In this case, the continuous-form sheet, similar to that having been used in a conventional line printer, is used. The continuous-form sheet, hereinafter, simply referred to as a "continuous sheet", used in the conventional line printer is a so-called fan-folded sheet having a plurality of sprocket holes provided at both side edges, at a predetermined interval along the longitudinal direction thereof, and arranged to be folded along perforated tear lines to enable the sheet to be readily cut off.

When a continuous sheet is employed in a laser beam printer that utilizes a heat roll fixing system, the length of the recording sheet feed path, from a transferring position of a transferring unit to a fixing position of a fixing unit, must be set to substantially equal the distance between the perforated tear lines of the continuous sheet, in order to prevent such a problem occurs as when the laser beam printer stops feeding the continuous sheet after the image forming operation, and a page, stopped during the fixing operation, is held between the pair of fixing rollers. Thus, unfixed toner, used in the process of the fixing operation, remains caught between the pair of the fixing rollers.

More specifically, since the continuous sheet is finally cut off along the perforated tear lines for use, no image must be formed within a predetermined region in the vicinity of the perforated tear lines. Thus, in a laser beam printer by which images are formed for each page, the vicinity of the tear lines, where no image is formed, is arranged to be stopped at the transferring position of the transferring unit. Consequently, when the length of the recording sheet feed path, from the transferring position to the fixing position, is set to substantially equal the distance between the perforated tear lines of the continuous sheet, the above problem can be avoided, because the vicinity of the tear lines, where no image is formed, is caused to be located at the fixing position at the fixing unit where the action is effected, when the laser beam printer stops to feed the continuous sheet.

As a result, however, a problem arises in that the printer as a whole is made unnecessarily large in size to provide the necessary feed length for the recording sheet. A plurality of different kinds of continuous sheets, respectively, having a different distance between perforated tear lines (i.e., a length of a page), cannot be interchangeably used in this type of laser beam printer (i.e., continuous sheets having a different distance between perforated tear lines cannot be used).

Furthermore, it is necessary to additionally feed the continuous sheet, at least, in an amount corresponding to one page in order to execute the fixing operation on the last page. Moreover, it is necessary to feed the continuous sheet in an amount corresponding to one page without an image forming operation in order to completely discharge the continuous sheet, on which the image forming operations have been executed, from the laser beam printer. Thus, the continuous sheet may be wasted.

SUMMARY OF THE INVENTION

It is therefore an object of the present invention to provide an improved electrophotographic printer using a continuous sheet arranged in such a manner that a plurality of different kinds of continuous sheets, respectively having different length intervals of perforations, can be employed. Further, it is possible to set the length, from the transfer unit to the fixing unit, independently of the intervals between the perforations of the continuous sheet. Thus, it is possible to reduce the total volume of the printer.

For this purpose, according to the invention, there is provided a printing device, capable of employing at least a continuous-form recording sheet having a plurality of printing segments on which an image is to-be formed, each of the segments being designated by a plurality of transverse perforations provided on the continuous-form recording sheet at predetermined intervals of length along a longitudinal direction thereof.

A feeding mechanism is provided for feeding the continuous-form recording sheet along a predetermined feeding path.

A forming mechanism is provided for forming the image on the continuous-form recording sheet that has been fed by the feeding mechanism.

A detecting device is further provided for detecting a boundary on the continuous-form recording sheet, fed by the feeding mechanism, between segments on which the image forming operation, by the forming mechanism, has been executed and on segments on which the image forming means is not executed.

A cutting mechanism is further provided for cutting the continuous-form recording sheet at its boundary, whereby the continuous-form recording sheet is divided into two portions along its predetermined feeding path.

DESCRIPTION OF THE ACCOMPANYING DRAWINGS

DETAILED DESCRIPTION OF THE PREFERRED EMBODIMENTS

Figure 1A:
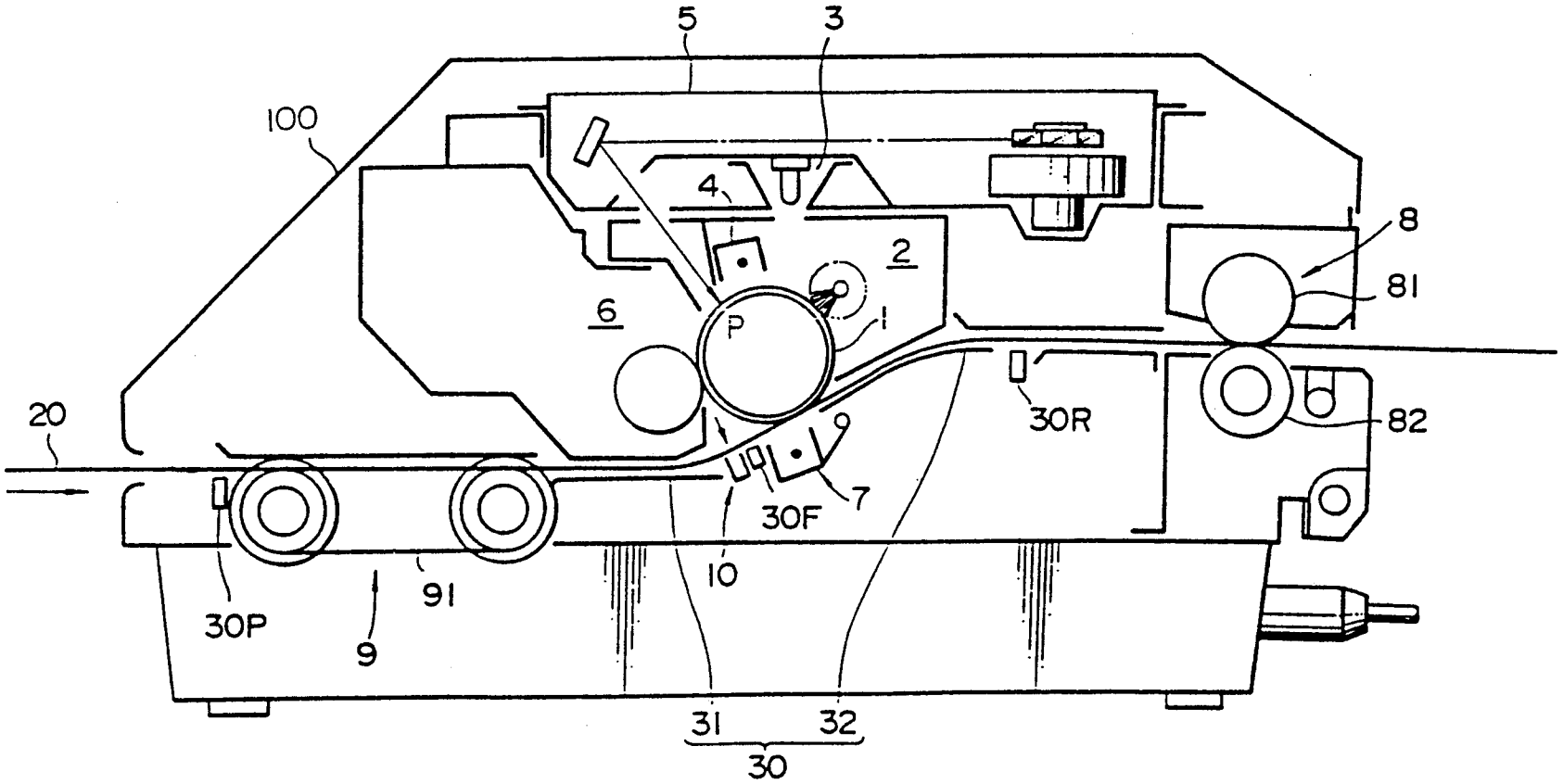
FIG. 1A is a schematic structural drawing of a laser beam printer used in an embodiment of the electrophotographic printer utilizing a continuous-form recording sheet according to the present invention.

Referring to the drawings, an embodiment of the present invention will subsequently be described hereinafter.

Figure 1B:
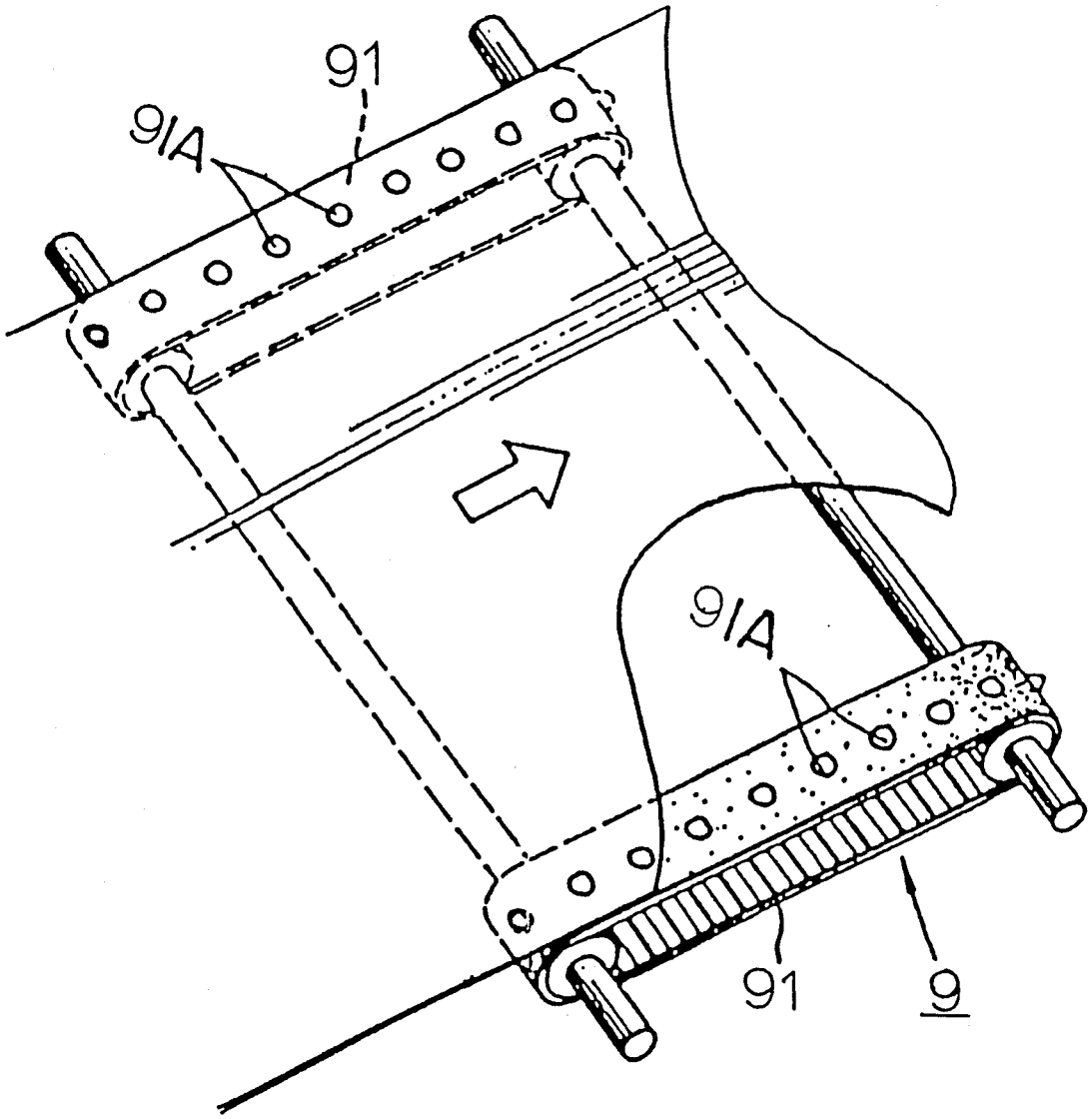
FIG. 1B is a perspective view showing a tractor belt incorporated in the printer of FIG. 1A.
Figure 1C:
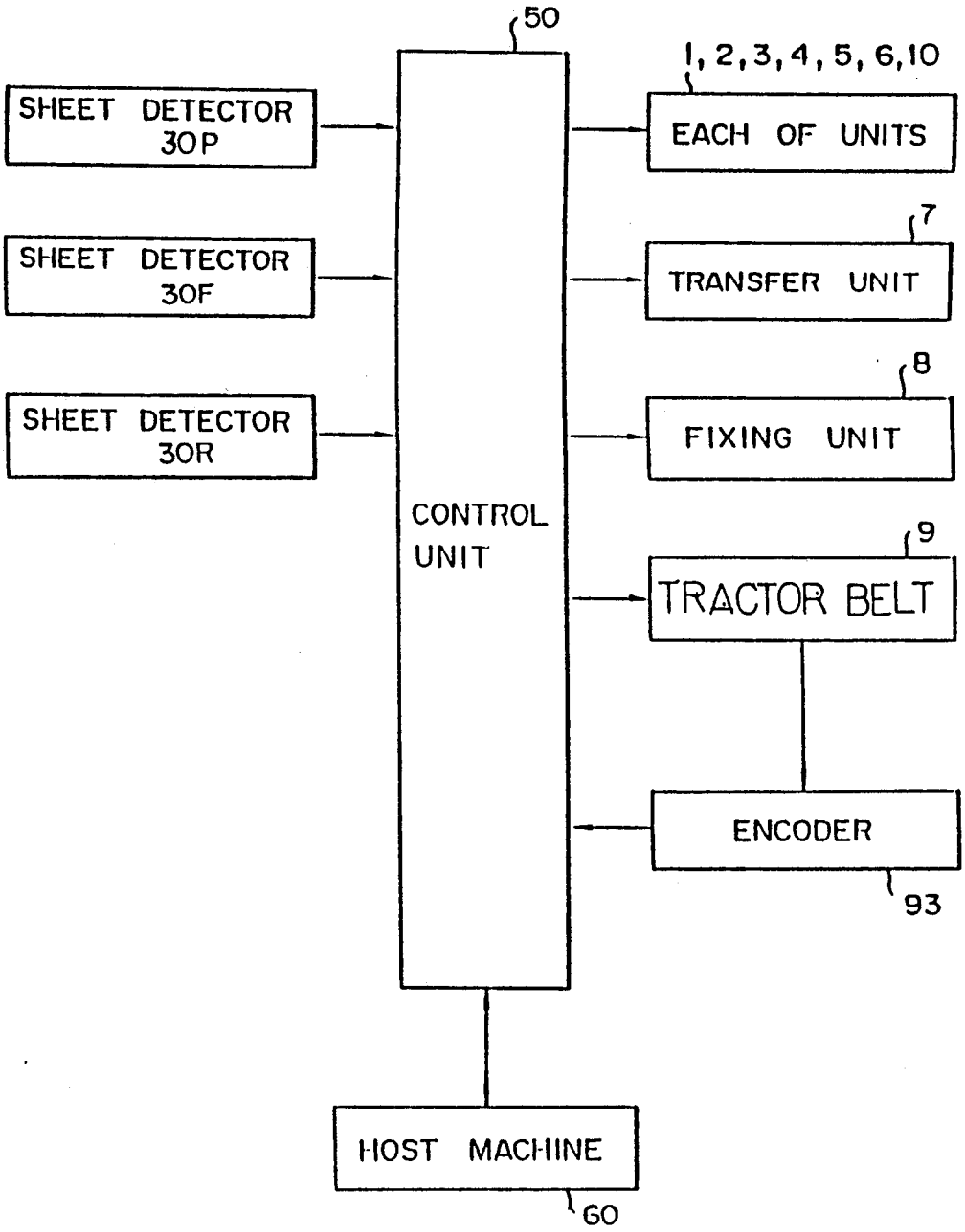
FIG. 1C is a block diagram of a controlling system for controlling the printer of FIG. 1A.

FIG. 1A is a schematic structural drawing of a laser beam printer used in an embodiment of the electrophotographic printer using a continuous-form recording sheet according to the present invention, and FIG. 1C is a block diagram of a controlling system for controlling the printer of FIG. 1A.

The laser beam printer shown in FIG. 1A is designed to form images or printing data received from a computer, or the like, on fan-folded sheet 20 which is a continuous-form sheet used as a recording medium by the so-called electrophotographic method to obtain hard copies.

A photoconductive drum 1 is driven to rotate by a main motor, not shown, at a predetermined peripheral speed. A toner cleaning unit 2, a charge removing unit 3, a charging unit 4, a scanning optical system 5 for introducing a laser beam onto the photoconductive drum 1, a developing unit 6, and a transfer unit 7 are successively disposed along the rotational direction of the photoconductive drum 1.

There is arranged on the left-hand and the right-hand side 31, 32 of the drum 1, a recording sheet feeding path 30, with the transfer unit 7 positioned therebetween. Transfer unit 7 is disposed under the photoconductive drum 1. A tractor belt 9 is disposed along the recording sheet feeding path 31 at the upstream side of the photoconductive drum 1, whereas a fixing device 8 is disposed along the recording sheet feeding path 32 at the downstream side of the photoconductive drum 1. In other words, the photoconductive drum 1 is located between the tractor belt 9 and the fixing device 8 along the sheet feeding path. The fan-folded sheet 20 is fed by the tractor belt 9 toward the photoconductive drum 1. The transferring operation of a toner image, that has been formed at the developing unit 6, is executed at the transfer unit under the photoconductive drum 1. Thus the fan-folded sheet 20 is further fed toward the fixing device 8.

Moreover, a cutter 10 is disposed along the recording sheet feeding path 31 between the tractor belt 9 and the photoconductive drum 1. In other words, the cutter 10 is disposed at the downstream side of the tractor belt 9 and upstream side of the photoconductive drum Further, a plurality of reflection type photo-sensors "30P", "30F" and "30R", used for detecting the presence of the fan-folded sheet 20, are disposed along the recording sheet feeding path 30. At the upstream side of the tractor belt 9, the sensor "30P" is disposed, the sensor "30F" is disposed between the tractor belt 9 and the photoconductive drum 1, further, the sensor "30R" is disposed between the photoconductive drum 1 and the fixing device 8. When the presence of the fan-folded sheet 20 is detected by the sensor "30P", it is determined that the fan-folded sheet 20 is mounted on the laser beam printer. When the presence is not detected by the sensor "30R", it is determined that the fan-folded sheet 20, on which the transferring operation has been executed, will be discharged from the laser beam printer after a predetermined period, i.e., period required for feeding the fan-folded sheet 20 between the positions of the sensor "30F" and the fixing device 8.

The tractor belt 9 is composed of two endless belts, 91, each provided with projections, 91A to be fitted into the respective sprocket holes bored at both the side edges of the fan-folded sheet 20, as shown in FIG. 1B. The endless belts 91 are disposed in parallel relationship with each other. The intervals of the projections 91A are arranged substantially similar to the intervals of the sprocket holes on the fan-folded sheet 20, allowing the fan-folded sheet 20 to feed as the endless belts 91 are driven to rotate. The endless belts 91 are driven by a drive motor, not shown, which is coupled to a pulley that is linked with one of the endless belts 91, which revolves in the direction that the fan-folded sheet 20 is fed. As shown in FIG. 1C, an encoder 93 is coupled to the tractor belt 9 for correctly identifying the amount of the fan-folded sheet fed past the tractor belt 9.

The fixing device 8 is arranged by disposing a pair of fixing rollers, adapted to be brought into contact with each other, between which the fan-folded sheet 20 is fed. The heat roller 81 is arranged to be heated at high temperature by a heating member, (e.g., a halogen lamp), incorporated within the heat roller 81. The backup roller 82 is arranged to be connected to a rotational drive member, not shown, and be driven to rotate at a predetermined peripheral speed that is substantially the same as the feeding speed of the fan-folded sheet 20.

As shown in FIG. 1C, there is provided a control unit 50 for controlling the driving operation of the tractor belt 9, the fixing operation executed by means of the fixing device 8, and the operation of respective processing units for the electrophotographic method (including the rotational driving operation of the photoconductive drum 1, the toner cleaning unit 2, the charge removing unit 3, the charging unit 4, the scanning optical system 5, and the developing unit 6). The control unit 50 is so arranged as to receive data from the encoder 93, linked with the tractor belt 9, and the photo-sensors "30P", "30F" and "30R"; and to control the respective processing units according to the data received from the encoder and the photo-sensors.

In the above constructed laser beam printer, the upper cover 100 is opened to mount the fan-folded sheet 20 on the laser beam printer by fitting the sprocket holes on the projections 91A. The leading edge of the fan-folded sheet 20 is located on the upstream side of the sensor "30F".

After the above sheet setting operation, the upper cover 100 is shut and a printing operation is started. After an operation start switch, not shown, is actuated initially, the tractor belt 9 is driven to feed the fan-folded sheet 20 toward the photoconductive drum 1. Scanning of the surface of the photoconductive drum 1 by exposure to a laser beam from the scanning optical system 5 along a direction of the rotation axis of the photoconductive drum 1 is begun when the leading edge of the fan-folded sheet 20 is detected by the sensor "30F". The laser beam from the scanning optical system 5 is controlled in an on/off operation, in accordance with the image information data, that relates to the image to be developed, which has been transmitted from the host computer 60, or the like. The photoconductive drum 1 is simultaneously rotated during the above scanning operation, and a latent image, corresponding to the image to be developed, is formed on a surface of the photoconductive drum 1. The peripheral speed of the photoconductive drum 1 and the feeding speed of the tractor belt 9 are arranged to be similar with each other. The latent image on the surface of the photoconductive drum 1 is developed at the developing unit 6 by adhering toner particles to form a visible image. In the transfer unit 7, the toner image is transferred onto the fan-folded sheet 20 that has been fed along the recording sheet feeding path 30 by the tractor belt 9, and fixed on the fan-folded sheet 20 by the fixing device 8. In FIG. 1A, the amount of rotation of the photoconductive drum 1 from a position "P", at which the laser beam is to be projected, to the transferring position corresponds to the addition of the amount of sheet feeding, in which the leading edge of the fan-folded sheet 20 is fed from the sensor "30F" to the transferring position, and the amount of sheet feeding in which the image forming start position on the fan-folded sheet 20 reaches the transferring position. In other words, when the peripheral speed of the photoconductive drum 1 and the feeding speed of the fan-folded sheet 20 are similar to each other, the latent image formed at "P" is transferred as a toner image at the image forming start position. The image forming start position can be arbitrarily set by controlling the distance between the sensor "30F" and the transferring position, or by adjusting a scan start timing onto the surface of the photoconductive drum after the sheet sensing operation is executed by the sensor "30F".

As described above, the fan-folded sheet 20 is fed by the tractor belt 9, photoconductive drum 1 and the fixing device 8. The feeding speed of these units is controlled so as to be similar to each other when at lest two units simultaneously feed the fan-folded sheet 20, so that an undesirable tension is not supplied on a surface of the fan-folded sheet 20, and so the fan-folded sheet 20 does not slacken during the feeding operation.

Figure 2A:
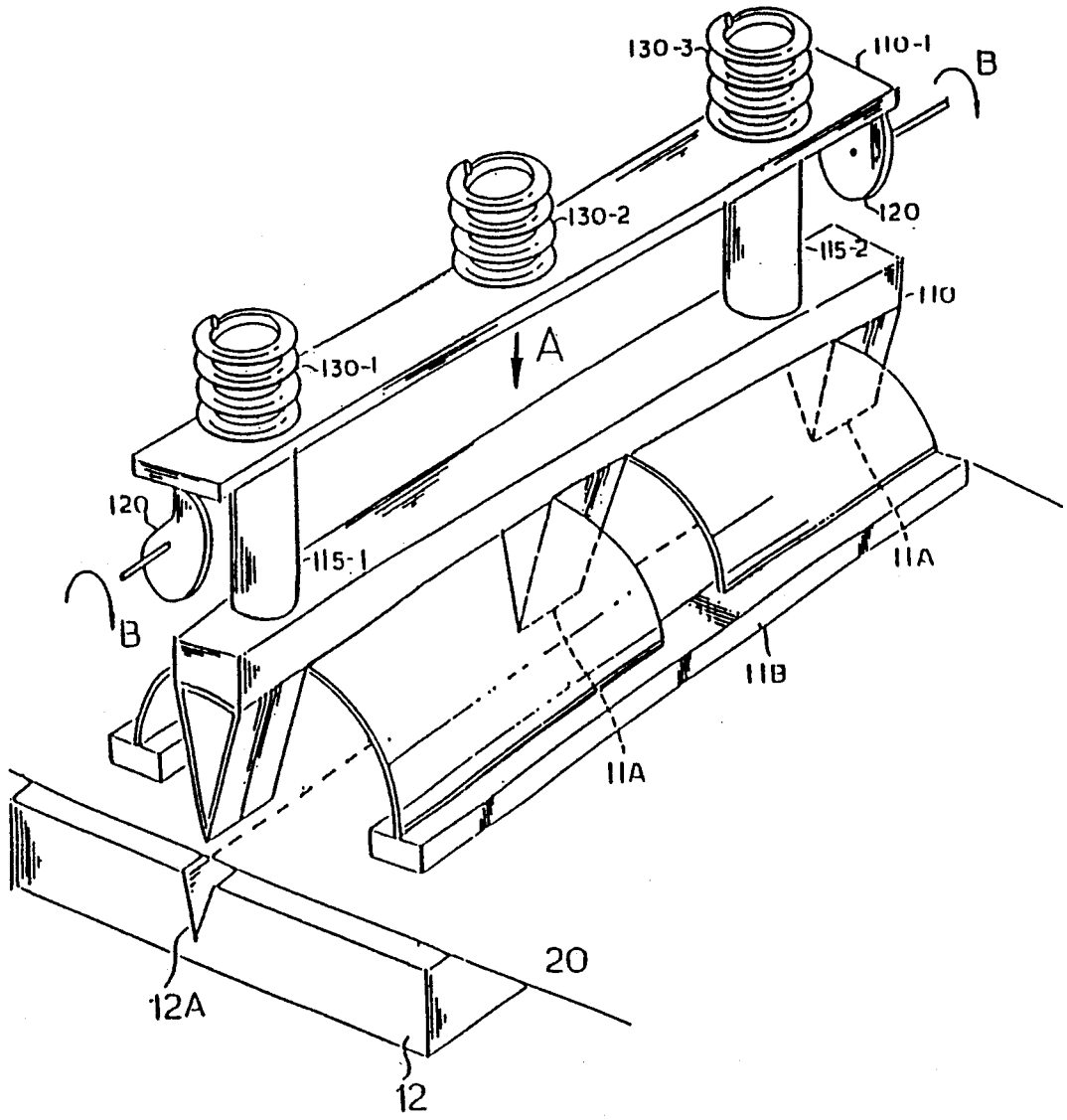
FIGS. 2A and 2B are a perspective view of a cutting member employed in the electrophotographic printer according to the present invention and a transverse sectional view thereof.

The cutter 10 includes an upper blade 11, as illustrated in FIG. 2A, and a lower blade 12 arranged opposite thereto. The fan-folded sheet 20 is arranged to be fed between the upper and lower blades 11, 12.

The upper blade 11 is, as shown in FIG. 2A is formed in a semicylindrical-shape by an elastic thin metal plate, and the length of the upper blade 11 is arranged to be substantially the same as the width of the fan-folded sheet 20. The plate is elastically deformed by a pressure force, as indicated by the two-dot line on FIG. 2B, and the deformation is recovered when the pressure force is released. A pair of pressure plates 11B are secured to the respective edge faces of the upper blade 11 to form a tension mechanism, described below. A plurality of blade edges 11A, in FIG. 2A, are intermittently provided in predetermined width along the width direction of the fan-folded sheet 20. The interval of length between the pressure plates, 11B is varied in accordance with the above deformation of the plate. Each of the blade edges 11A are formed as follows; the metal plate is cut in a predetermined length with both side edges positioned along the width direction thereof, the metal plate is bent at the center portion, and both side edges are connected with each other by a predetermined method, for example, soldering the side edges.

On the upper blade 1, a lower pressure plate 110 is secured in a width direction thereof, further, an upper pressure plate 110-1 is secured on the lower pressure plate 11 through a plurality of shafts, for example, the two shafts in this embodiment, 115-1, 115-2. The upper pressure plate 110-1 is downwardly biased, as indicated by an arrow "A" in FIG. 2A, by a predetermined biasing member, for example, a plurality of elastic spring members 130-1, 130-2, 130-3 arranged to contact the upper surface of the upper pressure plate 110-1 along a longitudinal direction thereof. Further, a pair of cam plates 120 are provided between the upper plate 110-1 and the lower pressure plate 110. These cam plates 120 are arranged to be synchronously rotated with each other.

Figure 2B:
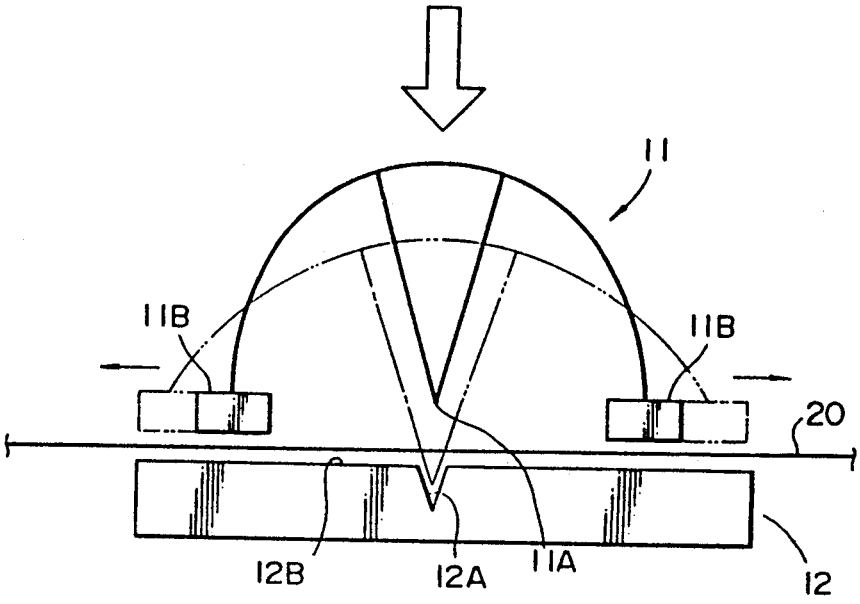

The lower blade 12 has breadth and length substantially the same as those of the upper blade 11, as shown in FIG. 2B, which is a transverse sectional view of the cutter 10. There is formed a recess 12A in lower blade 12, having a predetermined depth for receiving the blade edges 11A.

The control unit 50 controls the pair of cam plates 120 that are to be rotated as indicated by arrows "B" in FIG. 2A, when a trailing edge of the page, on which the image forming operation is to be finished, reaches the position above the recess 12A.

The pressure plates 110 and 110-1 are forced down by means of the elastic spring members. 130-1, 130-2, 130-3. The upper blade 11 is deformed and the fan-folded sheet 20 is cut by the blade edges 11A at the perforation with the blade edges 11A being inserted into the recess 12A, as shown in FIG. 2B by the two-dot lines. At this time, the pair of pressure plates 11B of the tension mechanism pressures the fan-folded sheet 20 against the surface of the lower blade 12, and respectively move in both forward and reverse directions along which the fan-folded sheet 20 is fed due to the movement of both edges of the metal plate forming the upper blade 11. The fan-folded sheet 20 can thus be cut smoothly even if it is being fed. In other words, both edges of the upper blade 11 move when the upper blade 11 is forced down and cause the pair of pressure plates 11B to stretch the fan-folded sheet 20 in forward and reverse directions along which the fan-folded sheet 20 is fed, and the blade edges 11A are dashed to the perforation, causing the fan-folded sheet 20 to be readily cut at the perforation.

In this case, the control unit drives the cutter 10 to tear the fan-folded sheet 20 at the perforation, when the rear-end perforation, i.e., the perforation between the last page on which the image forming operation has been executed and the following page, is located above the recess 12A, in a case where a plurality of pages are to be output. If the number of pages to be output is one, the cutter is operated when the rear-end perforation of the page is located above the recess 12A. After the cutting operation, the control unit 50 controls the tractor belt 9 to stop in order to cease the feeding operation of the fan-folded sheet 20.

Figure 4:
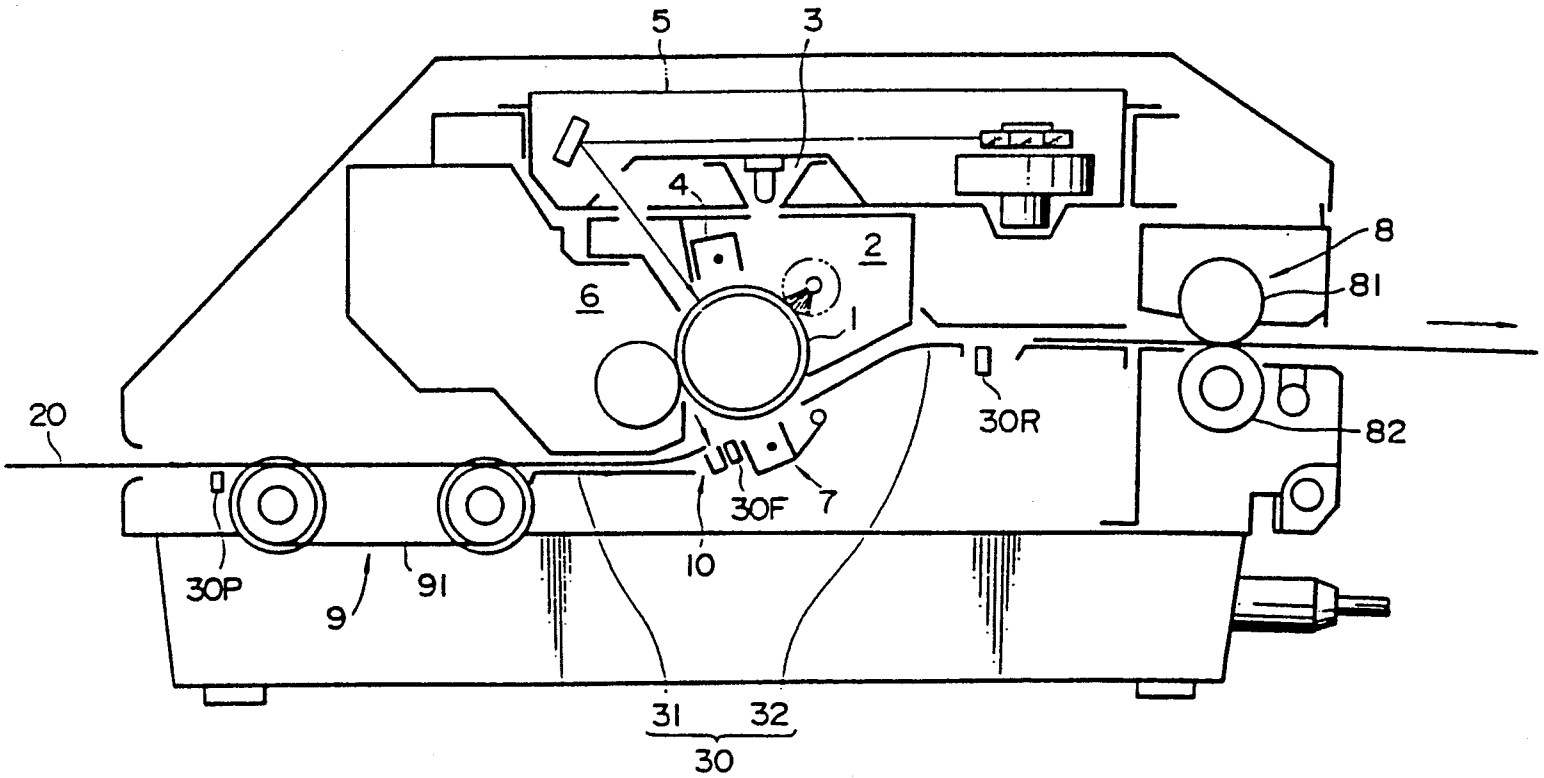
FIG. 4 is a diagram illustrating the printer, according to the present invention, used in a sheet feeding operation.

As a result, the feeding operation of the fan-folded sheet 20, on which the image forming operation is not executed, is stopped. The sheet, on which the image forming operation has been executed and cut by means of the cutter 10, is discharged from the printer by the fixing device 8, as shown in FIG. 4.

When a new image is to be formed on the fan-folded sheet 20, the tractor belt 9 is driven to feed the fan-folded sheet 20. The leading edge of the fan-folded sheet 20 is detected by the photo-sensor "30F". After the cutting operation executed by the cutter, the position of the leading edge of the remaining fan-folded sheet 20 is theoretically identified only based upon the amount of feed, since the position of the cutter 10 is accurately designated in the sheet feeding path. However, it is preferable to use the sensor "30F" in order to detect the leading edge of the fan-folded sheet 20, because the leading edge is shifted in the sheet feeding path when the cutter 10 is operated.

With the arrangement described above, the last page, with the formed image, is torn off at the rear-edge perforation thereof, and then, fed and discharged from the printer by means of the pair of rollers 81, 82 of the fixing device 8. Therefore, waste of the fan-folded sheet 20 is completely obviated. Moreover, the length of the recording sheet feeding path from the transferring position in the transfer unit 7 to the fixing position in the fixing device 8 can be set irrespective of the perforation intervals of the fan-folded sheet 20. The printer can therefore be made compact and extensively usable for recording sheet with different perforation intervals.

Figure 5:
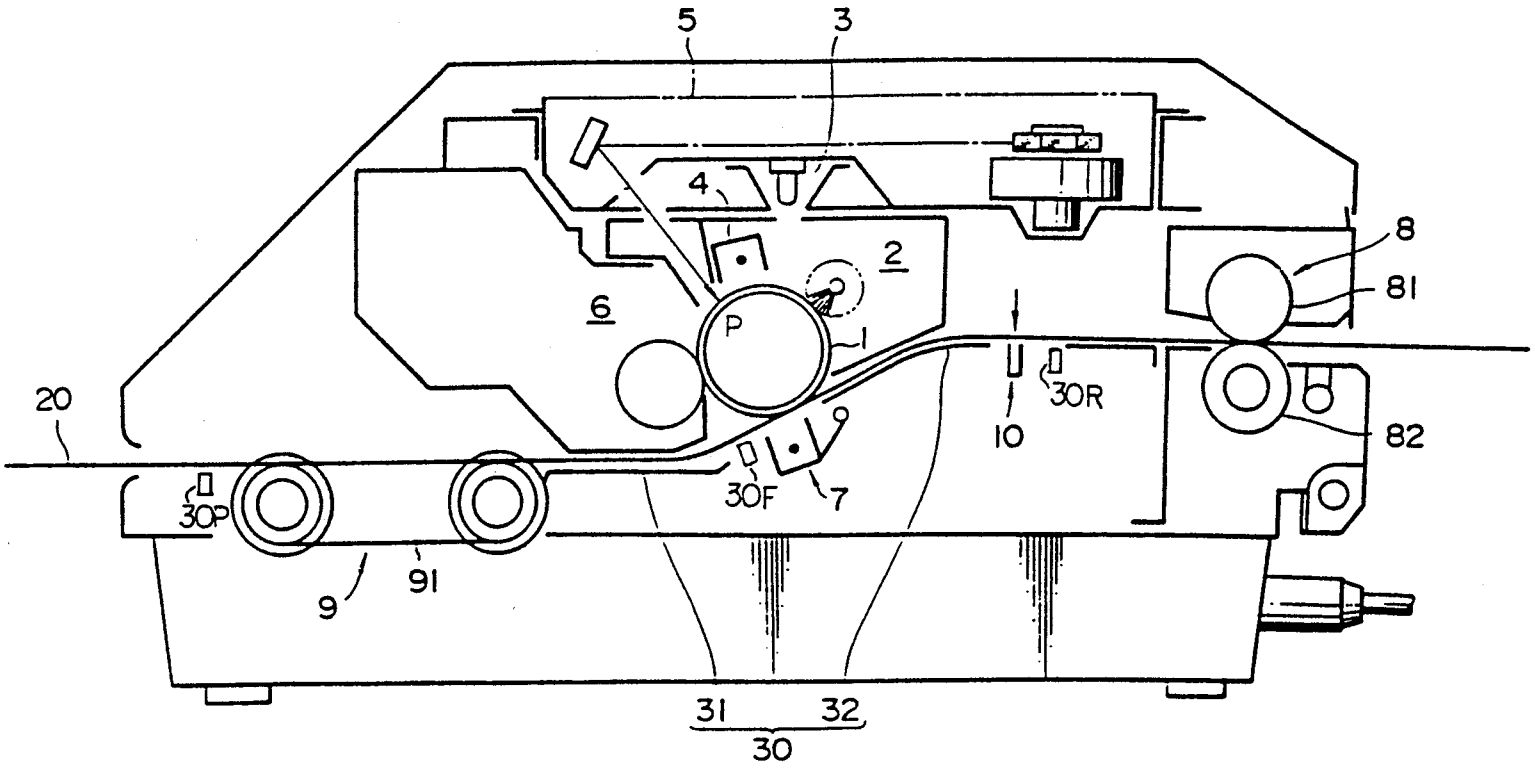
FIG. 5 is a schematic structural drawing of another laser beam printer used in another embodiment of the present invention.

Although the cutter 10 is located between the tractor belt 9 and the photoconductive drum 1 in this embodiment, it may be arranged between the photoconductive drum 1 and the fixing device 8, as shown in FIG. 5, wherein the driving of the tractor belt 9 can be made to be reversible. With this arrangement, an effect similar to that in the above described embodiment can be obtained by reversely rotating the tractor belt 9 to backwardly feed the leading edge of the following page, or the transfer start position of the following page, until it is located at the upstream side of the sensor "30F". As described above, the positions of the leading edge of the following page are theoretically identified without the sensor "30F". However, it is preferable to use the sensor "30F" such as in the above described embodiment.

Figure 3:
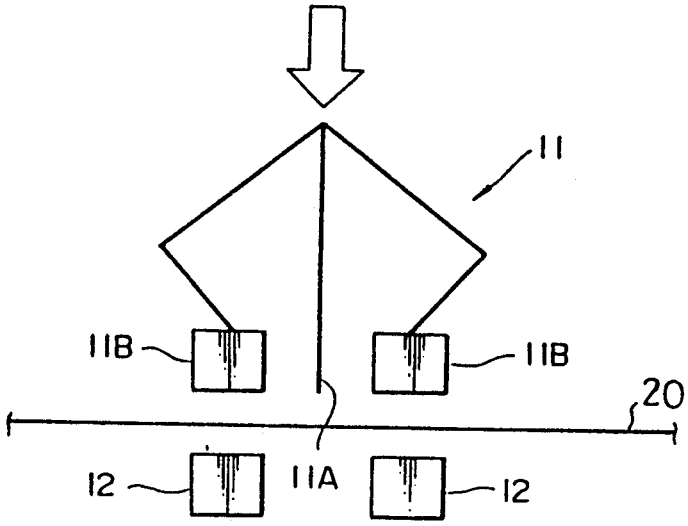
FIG. 3 is a transverse sectional view of another cutting member employed in the electrophotographic printer according to the present invention.

In addition, the construction of the cutter 10 is not limited to that shown in the above described embodiment but may be constructed such as shown in FIG. 3, wherein the cutter 11 is arranged in such a manner that a plurality of plates are connected with each other. In this construction, when a cutter blade 11A is pressurized, as indicated by an arrow of FIG. 3, the fan-folded sheet 20 is nipped with a pair of pressure blades 11B and a pair of lower blades 12, then the fan-folded sheet 20 is cut by cutter blade 11A.

As described above, the fixing device may be freely located in respective of the perforation intervals of the continuous sheet used in a electrophotographic printer using a continuous-form recording sheet, according to the present invention. Consequently, the printer can be made not only compact, but also compatible for the perforation intervals of the continuous sheet. Moreover, waste of the continuous sheet can be completely avoided.

What is claimed is:

1. A printing device, capable of employing at least a continuous-form recording sheet having a plurality of printing segments on which a desired image is to be formed, each of said segments being designated by a plurality of transverse perforations provided on said continuous-form recording sheet at predetermined intervals of length along a longitudinal direction thereof, said printing device comprising:

means for feeding said continuous-form recording sheet along a predetermined feeding path;

means for forming said desired image on said continuous-form recording sheet having been fed by said feeding means;

means for detecting a boundary on said continuous-form recording sheet, fed by said feeding means, between the segments on which an image forming operation by said forming means has been executed and the segments of said continuous-form recording sheet which have not been recorded upon;

means for cutting said continuous-form recording sheet at said boundary, said cutting means comprising a plurality of blade members, integrally formed on a semicylindrical-shaped elastic plate member arranged to be located along a width direction of said continuous-form recording sheet, for pressurizing said boundary between said segments, wherein said semicylindrical-shaped elastic plate member has a length substantially equal to said width of said continuous-form recording sheet;

a tension mechanism, which is arranged to be operable when said continuous-form recording sheet is cut by said blade member, for stretching said continuous-form recording sheet in opposite directions along a longitudinal direction thereof; and means for engaging said cutting means, located beneath said continuous-form recording sheet and providing an anvil surface against which said cutting means applies pressure;

whereby said continuous-form recording sheet is divided into two portions along said predetermined feeding path.

2. The printing device of claim 1, wherein said cutting means contacts said continuous-form recording sheet simultaneously with said stretching.

3. The printing device according to claim 1, wherein said feeding means comprises a tractor belt including a pair of rotary endless belts respectively having a plurality of projections arranged to be fitted to sprocket holes provided on both side edges of said continuous-form recording sheet.

4. The printing device according to claim 1, wherein said forming means comprises a photoconductor drum having a circumferential surface on which a latent image corresponding to said desired image is formed, said circumferential surface being arranged so that toner temporarily adheres to said surface, to form a toner image in accordance with said latent image, and contacted with said continuous-form recording sheet for transferring said toner image onto said continuous-form recording sheet.

5. The printing device according to claim 1, wherein said fixing means comprises rollers adapted to be brought into contact with each other, between which said continuous-form recording sheet is fed, one of said rollers being arranged to be heated at a predetermined temperature.

6. The printing device according to claim 1, wherein said cutting means is located between said feeding means and said forming means.

7. The printing device according to claim 1, wherein said cutting means is located between said forming means and said fixing means.

8. The printing device of claim 1, said tension mechanism further comprising means for applying forces in opposite directions, said means for applying forces being operatively connected to said semi-cylindrical shaped elastic plate member.

9. A printing device using an electrophotographic system, capable of employing at least a continuous-form recording sheet having a plurality of printing segments on which a desired image is to be formed, each of said segments being designated by a plurality of transverse perforations provided on said continuous-form recording sheet at predetermined intervals of length along a longitudinal direction thereof, said printing device comprising:

means for feeding said continuous-form recording sheet along a predetermined feeding path;

means for forming said desired image on said continuous-form recording sheet having been fed by said feeding means;

means for fixing said desired image having been formed by said forming means on said continuous-form recording sheet;

means for detecting a boundary on said continuous-form recording sheet, fed by said feeding means, between the segments on which an image forming operation of said forming means has been executed and the segments of continuous-form recording sheet which have not been recorded upon;

means for cutting said continuous-form recording sheet at said boundary, said cutting means comprising a plurality of blade members, integrally formed on an elastic plate member arranged to be located along a width direction of said continuous-form recording sheet, for pressurizing said boundary between segments;

means for engaging said cutting means, located beneath said continuous-form recording sheet and providing an anvil surface against which said cutting means applies pressure;

whereby said continuous-form recording sheet is divided into two portions along said predetermined feeding path.

10. The printing device of claim 9, further comprising:

means for applying forces to said continuous-form recording sheet in opposite longitudinal directions, transverse to the direction in which said blade members pressurize said boundary between segments.

* * * * *